United States Patent [19]

Eddy

[11] 4,332,048

[45] Jun. 1, 1982

[54] LOCKABLE SUPPORT FLOAT

[76] Inventor: Roger C. Eddy, 3101 Fernwood La., New Castle, Pa. 16105

[21] Appl. No.: 126,250

[22] Filed: Mar. 3, 1980

[51] Int. Cl.[3] ..... B63B 21/52; B63B 51/02

[52] U.S. Cl. ..... 441/1; 114/267

[58] Field of Search ..... 114/267; 9/8 R; 4/497, 4/504, 505; 24/118, 127, 213 R, 115 G, 115 K, 257

[56] References Cited

U.S. PATENT DOCUMENTS

| | | | |
|---|---|---|---|
| 2,401,453 | 6/1946 | Bell | 114/267 X |
| 2,634,474 | 4/1953 | Grayson | 24/115 G X |
| 2,881,552 | 4/1959 | Miller | 24/213 R X |
| 3,074,083 | 1/1963 | Schirmer | 9/8 R |
| 3,133,580 | 5/1964 | Katz | 24/213 R X |
| 3,436,775 | 4/1969 | Schlosser | 9/8 R |
| 3,540,063 | 11/1970 | Stanwood | 4/497 |
| 3,755,829 | 9/1973 | Walklet | 4/497 |
| 3,898,495 | 8/1975 | Liverg | 24/257 R |
| 4,224,707 | 9/1980 | Mariani | 9/8 R |

*Primary Examiner*—Trygve M. Blix

*Assistant Examiner*—Thomas J. Brahan

*Attorney, Agent, or Firm*—Reed, Smith, Shaw & McClay

[57] ABSTRACT

The invention is directed to a lockable support float, preferably blow molded, for use in swimming pools and the like. It comprises at least first and second expanded members having mateable ends which are adapted to slide over and lock onto a rope. Each member includes an opening that is eccentrically positioned therethrough and alignable with each other for sliding engagement with a rope. Each member includes either a female or a male locking member comprising concentrically positioned annular groove and annular extension, respectively. The annular groove includes at least two projections which extend over a portion of the groove, and the annular extension includes a flange around the perimeter thereof for locking engagement with said projections. By rotation of the locked members the respective openings therethrough become offset with respect to each other and any rope positioned therethrough is securely locked in the openings of the float.

10 Claims, 6 Drawing Figures

LOCKABLE SUPPORT FLOAT

FIELD OF THE INVENTION

The invention relates to a novel lockable support float structure for use in supporting swimming pool demarcation lines, fishing nets and the like, and, in particular to a floating structure amenable to blow molding techniques.

BACKGROUND OF THE INVENTION

Support floats for supporting swimming area demarcation ropes and fishing nets are common and well-known. Early support floats were made of wood, such as cork, or from other buoyant materials. More recently, these supports have been made from plastic materials such as polyethylene and styrene by blow molding or injecting molding techniques.

Support floats typically includes one or more parts having an opening therethrough through which a rope such as used to define swimming areas or fishing net structures is placed. In order to fix the support float on such a rope it has been common practice to include an end clamp adjacent to the opening through which a screw is positioned which passes through the rope. Also, conical wedges have been used between the rope and inner surface of the float opening through which it passes. All of the known fastening means, however, require substantial time and effort to lock the support float onto the rope. In some cases, such as in the case of the conical wedge, a float cannot be removed from the line without cutting the rope because of the permanence of such wedge structure. This is a significant disadvantage when a large number of floats are to be positioned and secured to a line or fishing net or where damaged support floats must be replaced.

It is, therefore, an object to the present invention to provide a support float which will lock onto a rope or similar means without the necessity of fastening devices such as screws, wedges or the like. It is also an object of the present invention to provide a support float which is susceptible of blow molding techniques and which will retain its buoyancy for substantial periods of time. Accordingly, it is the object of the present invention to overcome the many disadvantages associated with prior art support float structures.

SUMMARY OF THE INVENTION

Generally, the present invention comprises at least two, and preferably three, members each of which have mateable ends. Each of the members includes an opening therethrough which is a eccentrically positioned with respect to the center line of the support float. The openings are alignable with each other by rotation of at least one of the members for positioning therethrough a rope or similar means to be supported.

Each member includes at least a female or male end for securely joining the members together. A first member includes at least on one of its ends an annular groove concentrically positioned with respect to the center line of the float. The annular groove includes at least two projections that extend over a portion of said groove and abut the plane of the end.

Each second member includes at least one end having an annular extension having a width which is essentially the same as the depth of said annular groove. The annular extension includes an annular flange around the perimeter which is adapted to engagingly abut the respective innersurfaces of said flange and said projection. Thus, the inner and outer diameter of the extension inclusive of said flange is substantially the same as the inner and outer diameter of said annular groove. By positioning the annular extension within said annular groove so as to permit the flange to pass over the projection for engaging abuttment, the two parts will be securely fastened together.

Preferably, each of the first and second member are substantially cylindrical in configuration such that the opening therethrough and outer surface defined an annulus-like chamber filled with air. However, it is clear that other configurations can be used as well as various materials other than that preferred in the present invention. These and other advantages of the present invention will become apparent from a perusal of the following detailed description of a presently preferred embodiment taken in connection with the accompanying drawings.

DETAILED DESCRIPTION

Figure 1:
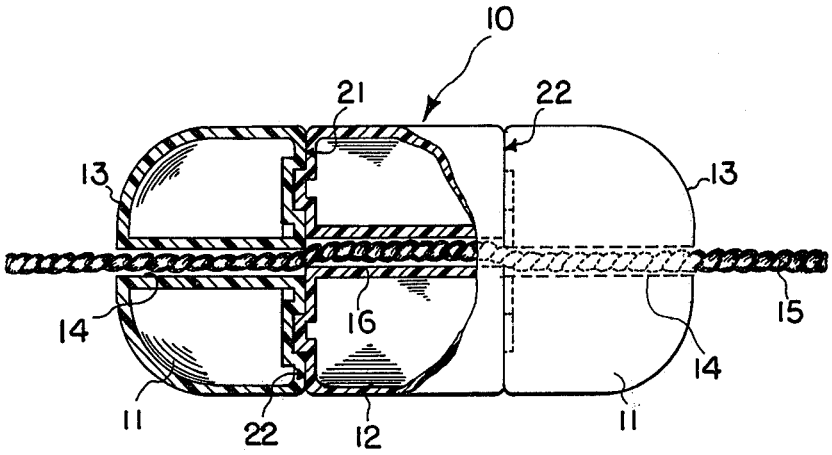
FIG. 1 is a side elevation of a lockable support float comprised of three members.

Referring to FIG. 1, lockable support float 10 comprises three members, a pair of first members 11 and a second member 12. As shown, first members 11 are substantially cylindrical in configuration and include end 13 which has been rounded for aesthetic purposes. However, it should be understood that the associated ends of each such member may be identical so that a float comprising a large plurality of alternating first and second members may be assembled. As is shown in FIG. 1, float 10 is positioned on rope 15 to be supported such that openings 14 and 16 of first and second members, respectively, are offset. Such offset, as described more fully hereinafter, locks float 10 onto rope 15.

Preferably, each of the first and second members 11 and 12 is blow molded from a material such as polyethylene into the desired configuration. Such blow molding will provide a member having an annular chamber defined by the outer walls of the member and the sidewalls of openings 14 and 16, respectively, of the first and second members. Such chamber provides the buoyancy required to support float 10 and a portion of rope 15. As common practice, a plurality of support floats 10 are positioned along the length of rope 15 to provide the necessary support of such rope on the top of water. However, it should be understood that such members could be fabricated by techniques other than blow molding or made from a solid block of buoyant material such as cork, styrofoam and the like. It being necessary only that the material or technique provide a float member which will support both itself and the item to be supported.

Figure 2:
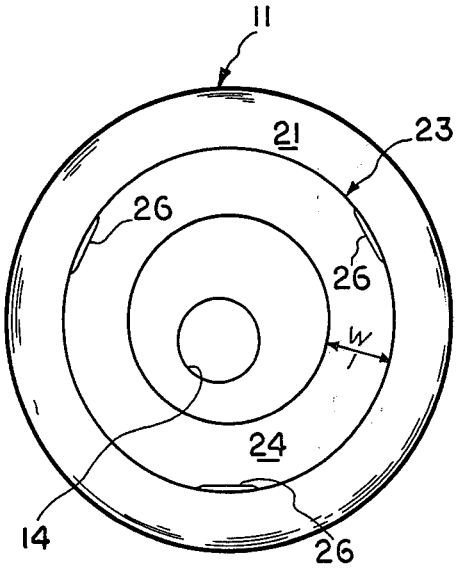
FIG. 2 is an end view of a first member showing the female connection means.
Figure 6:
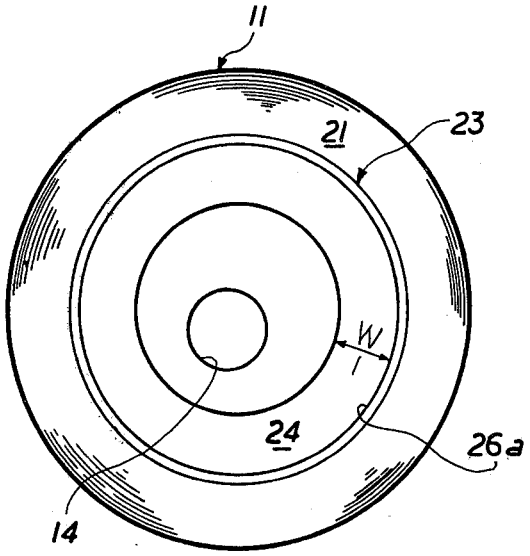
FIG. 6 is an end view of a first member showing another embodiment of the female connection means.

With reference to FIG. 2, end 21 of first member 11 is shown. As described above, first member 11 includes only one end 21 having connection means 23 in the presently preferred embodiment. However, it is to be understood that first member 11 may include two ends 21 having identical female connection means 23. Connection means 23 comprises an annular groove 24 concentrically positioned around the center line of float 10. Annular groove 24 includes at least two projections 26 positioned on the side wall of said groove. Projections 26 extend from the side wall of said groove over a portion of the groove and abut the plane of end wall 21. It has been found that projections 26 need extend only about 0.3 of an inch from said end wall to provide effective mating forces. It is possible to provide a continuous bead 26*a* (FIG. 6) instead of projections. Moreover, while such projections are shown extending from the outer side wall of said annular groove 24, it is clear that they may also be positioned on the inner wall or on both of said walls.

Figure 3:
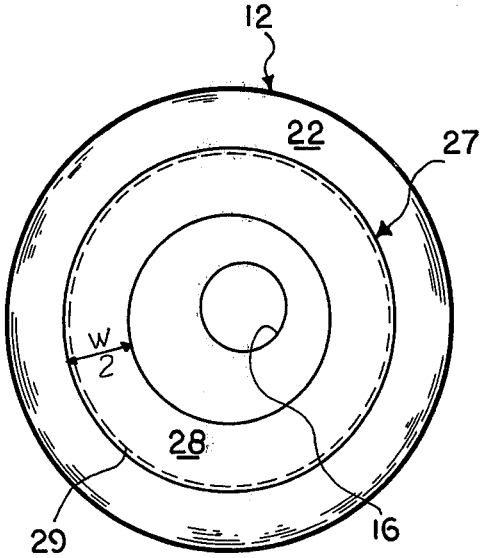
FIG. 3 is an end view of a second member showing the male connection means.

Referring to FIG. 3, end 22 of second member 12 is shown with male connecting means 27. Connecting means 27 comprises a annular extension 28 concentrically positioned with respect to the center line of float 10. Annular extension 28 includes annular flange 29 around the outer perimeter thereof. Annular extension 28 has a width $W_2$ including said flange 29 substantially equal to width $W_1$ of annular groove 24. Accordingly, the inner and outer diameter of annular groove 24 and annular extension 28 are substantially the same. Where projections 26 of groove 24 are positioned within the inner wall of said groove, annular flange 29 would be positioned on the inner surface of annular extension 28. Alternatively, where projections 26 are positioned on both the inner and outer walls of groove 24 extension 28 would preferably include a pair of annular flanges 29 positioned on the inner and outer surfaces thereof.

First and second members are pushed together to mate annular groove 24 and annular extension 28. In the mated position, projections 26 abut annular flange 29 to securely fastened each member to the other. In the case where members 11 and 12 are blow molded, it is desirable to stiffen ends 21 and 22 to facilitate entry of extension 28 over projections 26 and thus into groove 24.

In the preferred embodiment, the center lines of openings 14 and 16 are approximately one-eighth (⅛") inch offset from the center line of float 10. Because of the annular configuration of connecting means 23 and 27, first and second members 11 and 12 are rotatable in their mated position. During rotation thereof openings 14 and 16 are alignable with each other. From such aligned position, rotation 180° of one member with respect to the other will provide the maximum offset shown in FIG. 1. This offset crimps rope 15 as it passes from first member 11 to second member 12. While the offset between the first and second member provides a locking of the support float onto rope 15 a more substantial locking is afforded by the use of three members such as shown in FIG. 1 wherein two first members 11 are used together with second member 12 to create the three membered support float 10.

Figure 4:
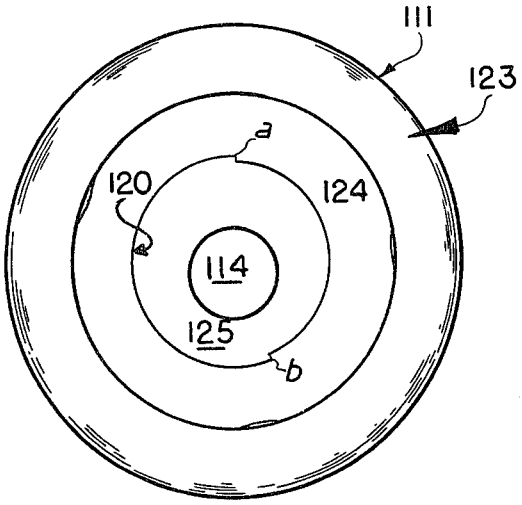
FIG. 4 is an end view of a first member showing a preferred female connection means.
Figure 5:
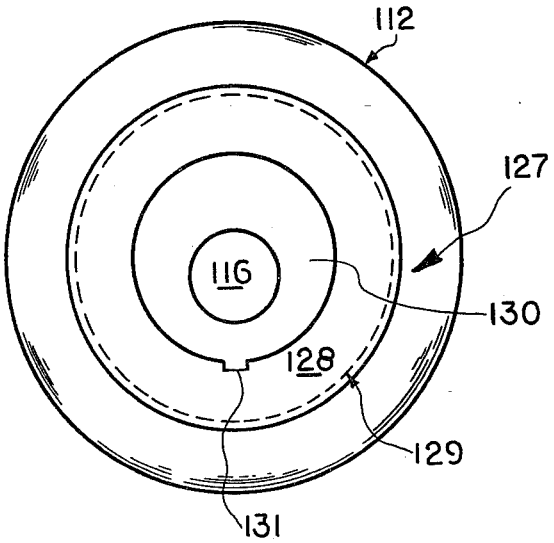
FIG. 5 is an end view of a second member showing a preferred male connection means.

Referring to FIGS. 4 and 5, female connector 123 includes a first annular groove 124 and a second locking groove 125. Locking groove 125 is provided with an outer keyway 120 which terminates to define stops a and b. In the preferred configuration, stops a and b are slightly more than 180° apart. Male connector 127 includes in addition to annular extension 128 locking extension 130 which extends beyond extension 128. Annular locking extension 130 is adapted to engagingly extend into locking groove 125 and 130 includes longitudinal key 131 which rides in keyway 120. Key 131 is adapted to prevent complete rotation of members 111 and 112 by abrittment with stops a and b. In this embodiment, stop b is positioned slightly beyond the point of maximum offset so that accidental twisting of the members 111 and 112 will lock, rather than unlock, the connectors. Accordingly, key 131 is most desirably positioned on the outer surface of locking extension at the point closest to the opening 116.

In both of the described configurations, substantial force is required to move locked support float 10 along rope 15, even when rope 15 is lubricated with water.

While presently preferred embodiments of the invention have been shown and described in particularity, the invention may be otherwise embodied within the scope of the appended claims.

What is claimed is:

1. A lockable support float comprising at least a first and second float member each of which includes at least one end having rotatable connecting means, each of said members including an opening therethrough eccentrically positioned with respect to the centerline of said support float and alignable with each other; said connecting means of said first member comprising a concentric annular groove having at least two projections extending across a portion of said groove; and said connecting means of said second member comprising a concentric annular extension having an annular flange at the outer edge thereof adapted to engage the projections of said groove, said extension being of substantially the same inner and outer diameter and width as said annular groove.

2. A lockable support float as claimed in claim 1 wherein said first and second float members are blow molded.

3. A lockable support float as claimed in claims 1 or 2 wherein said projections are positioned on the outer sidewall of said annular groove and said annular flange is positioned on the outer perimeter of said annular extension.

4. A lockable support float as claimed in claims 1 or 2 wherein said projections constitute a continuous bead.

5. A lockable support float as claimed in claims 1 or 2 wherein said float comprises a pair of first float members connected to a second float member, each of said first members having one connector means.

6. A lockable support float as claimed in claims 1 or 2 wherein said float comprises a plurality of first and second float members.

7. A lockable support float as claimed in claims 1 or 2 wherein said first and second float members are substantially cylindrical.

8. A lockable support float as claimed in claims 1 or 2 wherein first member includes a second annular groove concentrically positioned within said annular groove, said second annular groove having a circumferential outer keyway; and said second member having a second annular extension adapted to matably fit within said second annular groove, said second annular extension having a key adapted to ride in said keyway.

9. A lockable support float of claim 8 wherein said keyway is slightly greater than 180°.

10. A lockable support float of claim 8 wherein said keyway includes stops positioned slightly past the point of greatest eccentricity.

* * * * *